United States Patent [19]

Hoffman et al.

[11] Patent Number: 4,839,200

[45] Date of Patent: Jun. 13, 1989

[54] ENHANCED RESOLUTION INK JET PRINTING

[75] Inventors: William Hoffman, Horsham; Marcelo Lanas, Chalfont; Douglas Weiss, Hatfield, all of Pa.

[73] Assignee: Webcraft Technologies, Inc., N. Brunswick, N.J.

[21] Appl. No.: 45,513

[22] Filed: May 4, 1987

[51] Int. Cl.[4] ..... B41M 5/00

[52] U.S. Cl. ..... 427/265; 346/1.1; 346/135.1; 427/288; 428/195; 428/207; 428/211; 428/478.8; 428/514; 428/535

[58] Field of Search ..... 346/1.1, 135.1; 427/261, 288, 265; 428/195, 211, 207, 537.5, 478.8, 522, 535

[56] References Cited

U.S. PATENT DOCUMENTS 4,097,619 6/1978 Davis et al. ..... 427/150

4,627,642 12/1986 Peronneau et al. ..... 428/204

*Primary Examiner*—Bruce H. Hess

*Assistant Examiner*—P. R. Schwartz

*Attorney, Agent, or Firm*—Shlesinger & Myers

[57] ABSTRACT

The present invention describes a pre-treated recording media capable of receiving a high resolution aqueous-based ink jet printed layer as well as a method of preparing the same, wherein the method comprises the steps of: printing a recording media with an oil-based printing ink; drying the oil-based ink layer; coating over the oil-based ink layer with a water-soluble adhesive-like substance; drying the coating of adhesive-like substance; ink jet printing an aqueous-based ink layer onto the adhesive-like substance; and, drying the aqueous-based ink jet printed layer.

12 Claims, No Drawings

ENHANCED RESOLUTION INK JET PRINTING

FIELD OF THE INVENTION

This invention relates to ink jet printing of various recording media and more particularly to enhanced resolution of ink jet printing on pre-printed recording media.

BACKGROUND OF THE INVENTION

Ink jet printing has become increasingly popular as a method of producing printed advertisements, flyers and other printed media generally distributed to the public as well as printed media used in the private sector. While various ink jet printing techniques have been developed and tested, one common and reoccurring problem resides in the inability to achieve high resolution or image enhancement when using certain types of recording media especially when printing with aqueous-based inks.

Additional background including proposed solutions to the aforementioned problem is taught by Alden, U.S. Pat. No. 3,373,090; Bedell, U.S. Pat. No. 4,547,405; Jaeger, U.S. Pat. No. 4,503,111; Viola, U.S. Pat. No. 4,575,465; Viola, U.S. Pat. No. 4,592,951; IBM Technical Disclosure Bulletin, Vol. 21, No. 6, November, 1978; Japanese Pat. No. 191,083, published Nov. 24, 1982.

While the aforementioned patents and publication discuss treatment of recording media with various water-soluble polymers such as polyvinyl alcohol in order to increase the reception ability of such media to aqueous based inks, no one has previously proposed the application of a water-soluble adhesive or glue to a pre-printed recording media, i.e. a recording media such as uncoated or coated paper stock onto which an oil-based printing ink has been previously applied.

As a matter of clarification, the terminology "coated paper stock" refers to a fibrous sheet having a pigment-bearing resinous coating on one or both surfaces thereof. Usually, the pigment provides a white, bone or ivory coloration to the sheet. Most often, pigments producing a white coloration are used. The binder used in producing the coated paper stock is generally a synthetic or natural organic polymeric material. Typical binders include latices (e.g., styrene-butadiene, butadiene-acrylonitrile, etc.) film-forming polymers (e.g., polymethyl-methacrylate), and natural resins (e.g., casein, ammonium caseinate, starch, etc.). Coated paper stock generally has a gloss or semi-gloss appearance. In the advertising trade, papers having both sides coated are preferred.

When attempting to ink jet print an aqueous-based ink layer onto a recording media which has been pre-printed with an oil-based ink layer, especially a solid or uninterrupted oil-based ink layer, problems arise with regard to resolution of the aqueous ink jet printed layer. Typically, the aqueous ink jet printing will appear lighter in color and less uniformly dispersed. For example, the characters will be light and discontinuous in appearance wherein individual dots will be pronounced or discernable rather than blended together. Furthermore, the situation worsens as the thickness or density of the oil-based ink layer increases.

The foregoing problem arises due to the inability of the oil-based ink layer to properly receive and absorb or bind the aqueous-based ink. In fact, a significant percentage of the aqueous-based ink is actually repelled or deflected from the oil-based ink layer during the ink jet printing process, reducing the amount of ink which becomes deposited on the surface.

Oil-based ink printed layers are useful particularly with regard to advertising media, wherein the oil-based ink layer may contain pigments, dyes or the like in order to provide a colored zone for purposes of highlighting, etc.

SUMMARY AND OBJECTION OF THE INVENTION

The present invention is directed to ink jet printing of an aqueous-based ink onto recording media which has been pre-printed with an oil-based printing ink by applying a water-soluble adhesive or glue layer onto the oil-based ink layer prior to the ink jet deposition of the aqueous-based ink layer.

The provision of a water-soluble adhesive or glue layer greatly enhances the resolution of the aqueous-based printing ink. It is believed that the water-soluble adhesive layer acts to bind the aqueous-based ink jet printed layer, greatly reducing the quantity of aqueous-based ink that is repelled or deflected from the media substrate, or more precisely from the oil-based ink layer. Furthermore, the water-soluble adhesive promotes proper ink jet particle or dot spreading or dispersion. Proper dot spreading is essential in order to form characters which are continuous and uniform in nature rather than characters which are discontinuous, i.e., characters in which the individual ink particles or dots are individually discernable.

It is therefore an object of the present invention to provide enhanced resolution ink jet printing of aqueous-based ink onto a pre-printed recording media.

Another object of the present invention is to provide a pre-printed recording media with a water-soluble adhesive or glue layer for reception of a subsequently deposited aqueous-based ink jet printed layer.

A further object of the present invention is to provide enhanced resolution ink jet printing of an aqueous-based ink onto a pre-printed coated or uncoated paper stock.

These and other objects and advantages of the present invention will become apparent when taken in conjunction with the folowing detailed description.

DESCRIPTION OF THE INVENTION

A web or sheet of recording media, for example, uncoated or coated paper stock is initially printed with an oil-based printing ink by any conventional printing technique known in the art. After printing, the recording media is dried, for example, by passage through a conventional dryer. Next, the dried, printed recording media is passed through a coating machine wherein a layer of water-soluble adhesive or glue is applied thereto. The adhesive-coated, printed recording media is then dried in a conventional drying machine and subsequently ink jet printed with an aqueous-based printing ink. Following the ink jet printing stage, the recording media is again passed through a conventional dryer as a final step in the process.

By providing a water-soluble adhesive layer, high resolution of the aqueous-based ink jet printed layer was achieved even though the recording media had been previously printed with an oil-based printing ink.

The process described above may be conducted on a continuous basis, wherein the recording media is in the form of a continuous web. The application of the oil-based printing ink may be selective in nature, i.e., the oil-based printing ink may be applied only to selected areas of the recording media. The oil-based printing ink may include suitable dyes or pigments in order to achieve highlighting of selected areas of the recording media. Highlighting is especially suited for advertising purposes.

When the density of the oil-based ink layer is increased, the degree of resolution of the aqueous-based ink jet printed layer likewise increases when comparing pre-printed recording media that has been treated with adhesive versus preprinted recording media which has not been treated with adhesive.

The water-soluble adhesive or glue may be selected from any well known water-soluble adhesive-like substances, for example, polyvinyl alcohol, starch, gelatin, polyvinyl pyrolidone, etc.

Control over the density of the adhesive layer as well as control over the aqueous-based ink jet droplet size and deposition rate determine the degree of resolution of the aqueous-based ink jet printed layer in terms of dot spreading as previously discussed.

One specific feature of recording media treated according to the present invention is the ability of the uppermost layer, i.e., the aqueous-based ink jet printed layer, to be washed off, thereby leaving only the pre-printed oil-based ink layer visible. This occurs due to the fact that the adhesive layer is water-soluble. Water therefore removes both the water-soluble adhesive layer as well as the aqueous based ink layer applied thereon.

It is contemplated that such a wash-off feature could find application in the advertising trade and particular use in the field of chance games, lottery tickets or the like.

While this invention has been described in connection with different embodiments thereof, it will be understood that it is capable of further modifications, and this application is intended to cover any variations, uses or adaptations of the invention following, in general, the principles of the invention and including such departures from the present disclosure as come within known or customary practice in the art to which the invention pertains, and as may be applied to the essential features hereinbefore, set forth and followed in the scope of the invention or the limits of the appended claims.

What is claimed is:

1. A method for producing high resolution ink jet printing, comprising:

(a) printing a recording medium with an oil-based printing ink layer;

(b) drying said oil-based ink layer;

(c) applying a coating, which will effectively accept ink jet printing, over said oil-based ink layer;

(d) drying said ink jet acceptable coating;

(e) ink jet printing an aqueous-based ink layer onto the dried coating to at least partially cover the underlying oil-based printing layer; and (f) drying said aqueous-based ink jet printed layer.

2. A method as in claim 1, wherein:

(a) said recording medium is uncoated paper stock.

3. A method as in claim 1, wherein:

(a) said recording medium is coated paper stock having a glossy surface on at least one side thereof.

4. A method as in claim 1, wherein:

(a) said oil-based printing ink layer includes a dye, pigment or other coloring material.

5. A method as in claim 1, wherein:

(a) said recording medium is printed with an oil-based printing ink in selected areas only.

6. A method as in claim 1, wherein:

(a) said coating which will effectively accept ink jet printing is a water-soluble adhesive-like substance selected from the group comprising polyvinyl alcohol, starch, gelatin, polyvinyl pyrolidone, casein and hydroxyethyl cellulose.

7. A pre-treated recording medium capable of receiving a high resolution aqueous-based ink jet printed layer, comprising:

(a) a recording medium substrate;

(b) an oil-based printing ink layer on said recording medium;

(c) a dry coating which will effectively accept ink jet printing covering said oil-based printing ink layer; and, (d) an ink jet printed layer disposed on the coating and at least partially covering the underlying oil-based printing.

8. A pre-treated recording medium as in claim 7, wherein:

(a) said recording medium is uncoated paper stock.

9. A pre-treated recording medium as in claim 7, wherein:

(a) said recording medium is coated paper stock having a glossy surface on at least one side thereof.

10. A pre-treated recording medium as in claim 7, wherein:

(a) said oil-based printing ink layer includes a dye, pigment or other coloring material.

11. A pre-treated recording medium as in claim 7, wherein:

(a) said oil-based printing ink covers only selected areas of said recording media.

12. A pre-treated recording medium as in claim 7 wherein:

(a) said coating for effectively accepting ink jet printing is a water-soluble adhesive-like substance selected from the group comprising polyvinyl alcohol, starch, gelatin, polyvinyl pyrolidone, casein and hydroxyethyl cellulose.

* * * * *